United States Patent [19]

Shields, Jr.

[11] 3,955,255

[45] May 11, 1976

[54] TEXTILE CRIMPING APPARATUS

[75] Inventor: Richard E. Shields, Jr., Lincoln, Del.

[73] Assignee: John C. Draper, Milford, Del.

[22] Filed: June 27, 1975

[21] Appl. No.: 591,119

[52] U.S. Cl. ..... 28/1.6

[51] Int. Cl.[2] ..... D02G 1/12

[58] Field of Search ..... 28/1.6, 1.7, 72.14

[56] References Cited

UNITED STATES PATENTS

| | | | |
|---|---|---|---|
| 2,634,596 | 4/1953 | Pendleton et al. | 28/1.7 UX |
| 2,693,008 | 11/1954 | Upton et al. | 28/1.6 |
| 2,763,898 | 9/1956 | Sammons et al. | 28/1.6 |
| 2,856,640 | 10/1958 | Klein | 28/1.6 |
| 2,908,044 | 10/1959 | Whitney | 28/1.6 |
| 3,408,713 | 11/1968 | Parker et al. | 28/1.6 |
| 3,499,194 | 3/1970 | Schmick | 28/72.14 |
| 3,609,836 | 10/1971 | Morrison et al. | 28/1.6 |

FOREIGN PATENTS OR APPLICATIONS

| | | | |
|---|---|---|---|
| 2,021,103 | 11/1970 | Germany | 28/1.6 |
| 9,000 | 1841 | United Kingdom | 28/1.6 |
| 961,775 | 6/1964 | United Kingdom | 28/72.14 |
| 962,516 | 7/1964 | United Kingdom | 28/72.14 |
| 962,517 | 7/1964 | United Kingdom | 28/72.14 |

*Primary Examiner*—Robert R. Mackey
*Attorney, Agent, or Firm*—B. P. Fishburne, Jr.

[57] ABSTRACT

Textile stock, natural or synthetic, is taken from a carding machine or garnett and delivered to a sloping web infeed pan. Jets of air from air nozzles direct and boost the textile web into a trumpet immediately in advance of pressurized web compressing and feed rolls. Such rolls deliver the web directly into the mouth of a steam injected one piece crimping or stuffing box having a pressurized hinged cover plate to regulate the crimp in the material. The crimped web, after discharging from the stuffing box, is elevated by a slatted conveyor for delivery to a slowly turning crimped stock receptacle into which the stock is coiled without stretching it.

12 Claims, 8 Drawing Figures

FIG. 2
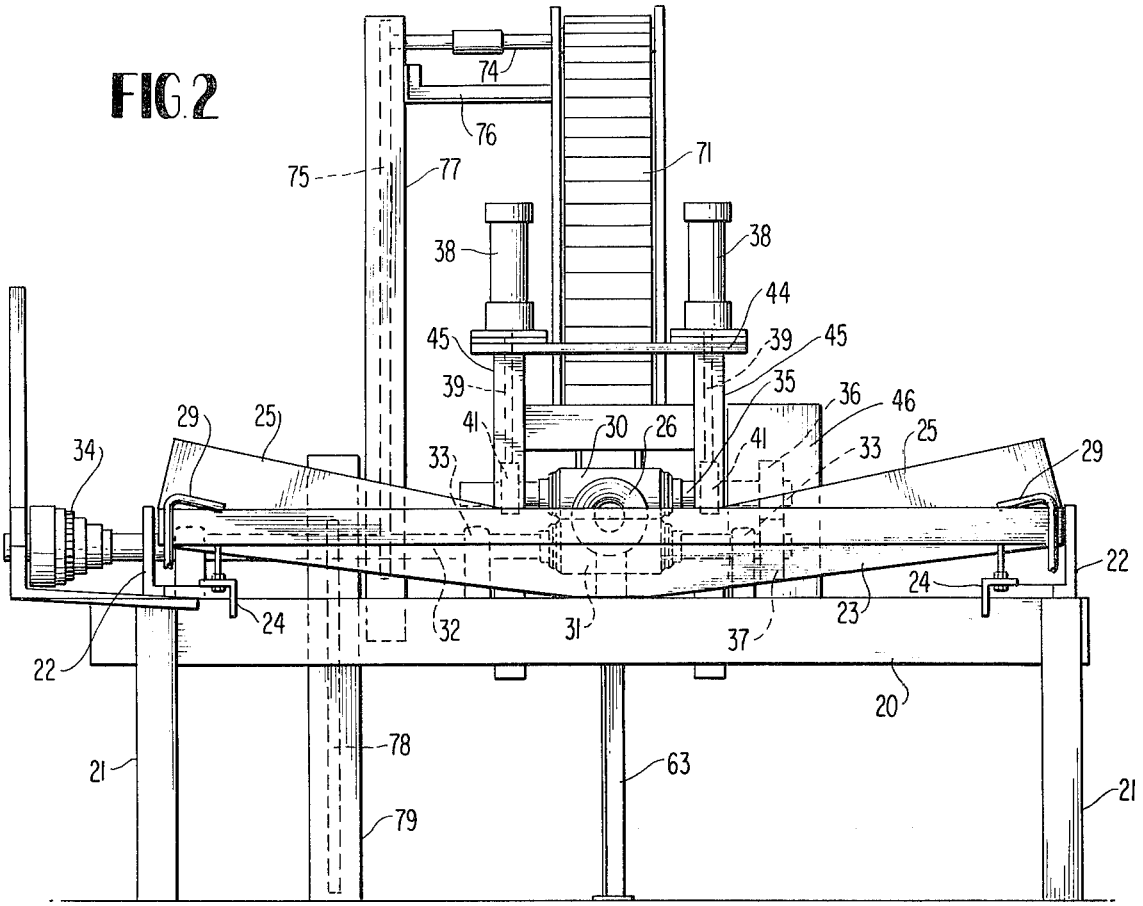
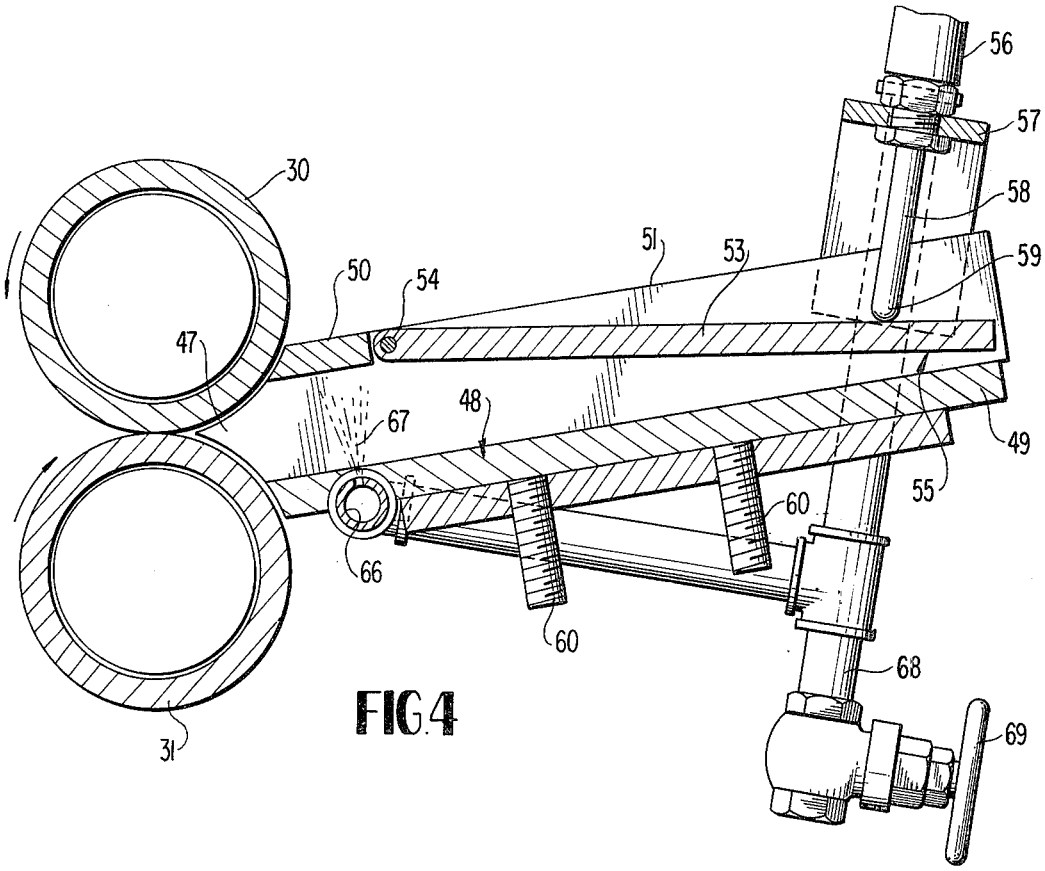
FIG. 4

20
21
22
23
24
25
26
29
30
31
32
34
38
43
44
46
48
49
50
51
52
53
54
56
57
68
70
71
72
74
75
76
77
79
81

FIG.6
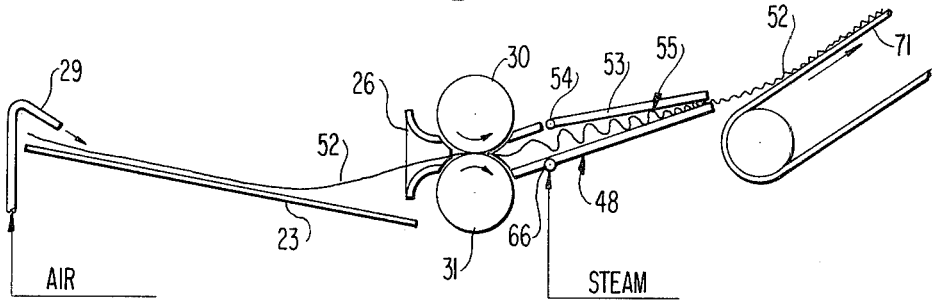
FIG.7
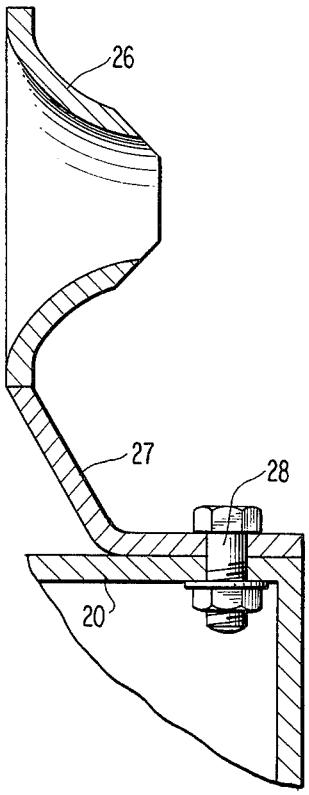
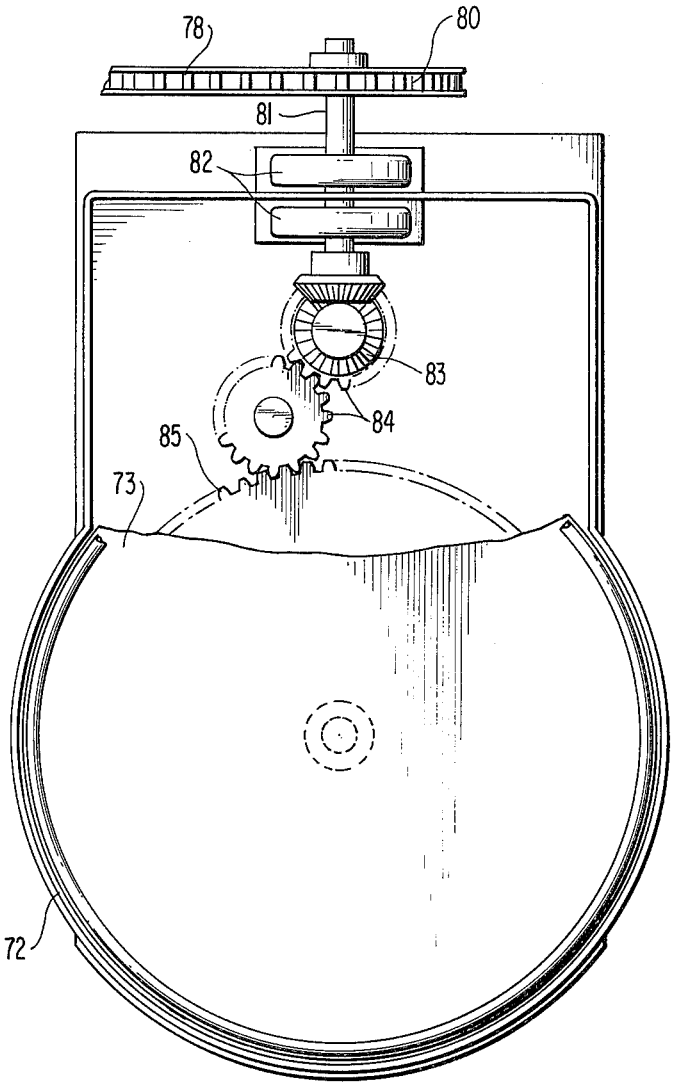
FIG.8

TEXTILE CRIMPING APPARATUS

BACKGROUND OF THE INVENTION

Apparatuses are known in the prior art for the purpose of crimping textile material and some examples of the prior art are shown in U.S. Pat. Nos. 2,156,723; 3,241,195 and 3,241,213. The objective of the present invention is to improve on the prior art by providing a more efficient and reliable textile crimping apparatus which completely handles or processes the textile stock from delivery by a carding machine or garnett to the gentle coiling of the crimped stock in a slowly rotating can or receptacle beneath the discharge end of an elevating conveyor.

A further object is to provide a crimping apparatus having improved means for delivering a loose web of short staple textile stock into the mouth of a flared trumpet immediately in advance of stock feeding and compression rolls which are power driven in synchronism while subjected to controlled compression.

Another object of the invention is to provide in such an apparatus an essentially one piece trouble-free crimping or stuffing box which will require no adjustment following initial installation.

A further and more general object of the invention is to provide a textile crimping apparatus which is rugged and durable, requires minimum maintenance, is simplified, and is entirely practical and relatively economical to manufacture.

Other features and advantages of the invention will become apparent during the course of the following description.

BRIEF DESCRIPTION OF DRAWING FIGURES

FIG. 2 is a front elevation of the apparatus.

FIG. 4 is an enlarged fragmentary vertical cross sectional view taken through the crimping or stuffing box and associated components of the invention.

FIG. 6 is a diagrammatic side elevational view of the apparatus illustrating its mode of operation.

FIG. 7 is an enlarged fragmentary cross sectional view of a trumpet and its mounting.

FIG. 8 is a fragmentary plan view, partly broken away, showing a rotating stock coiling can and its drive means.

DETAILED DESCRIPTION

Figure 1:
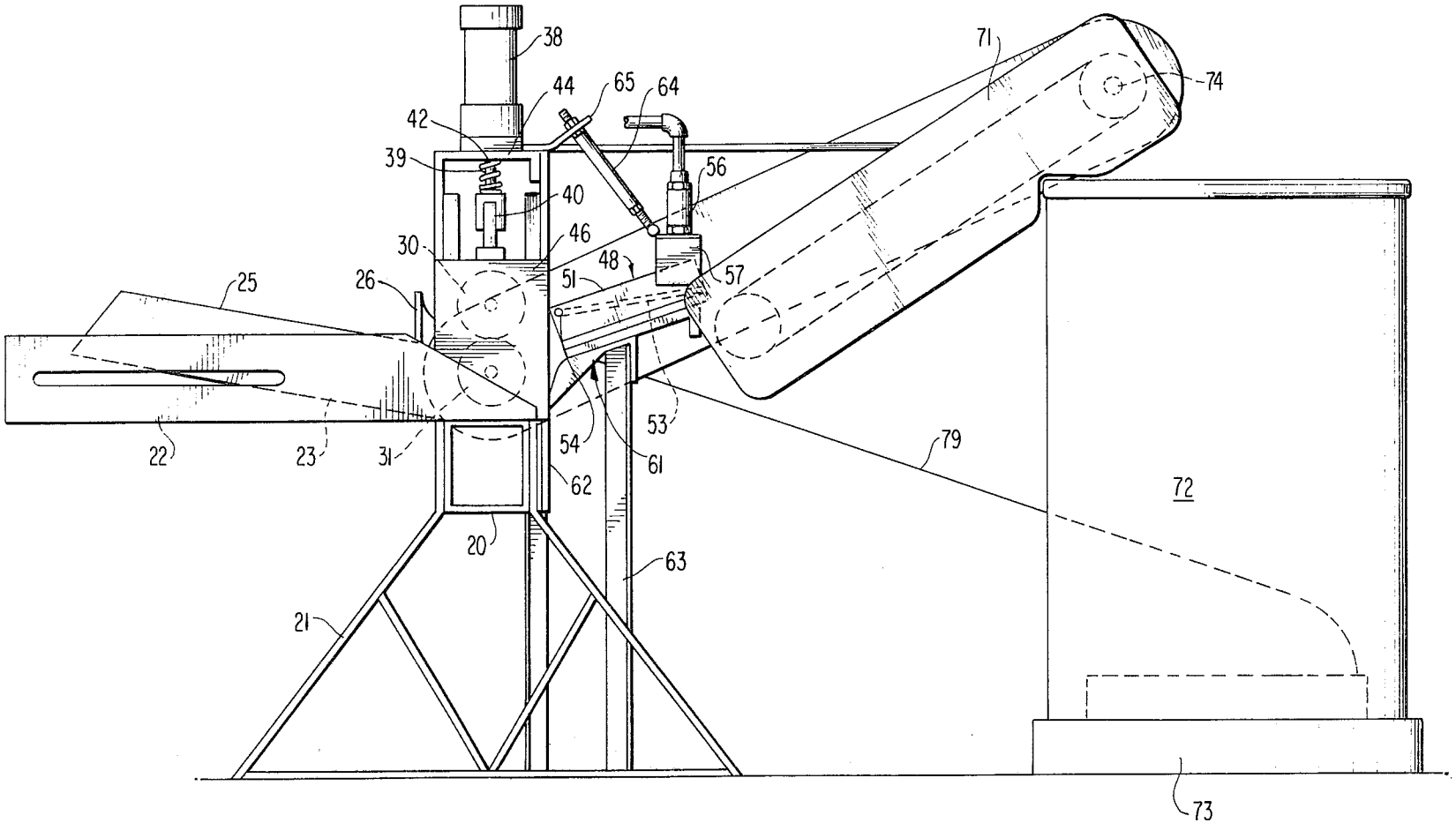
FIG. 1 is a side elevational view of a textile crimping apparatus embodying the invention.

Referring to the drawings in detail, wherein like numerals designate like parts, the crimping apparatus according to the invention comprises a main horizontal elevated support beam 20, preferably in the form of a rigid box member, supported at its opposite ends by sturdy leg frames 21, suitably secured thereto.

A pair of outrigger support arms 22 attached rigidly to the beam 20 near its opposite ends extend forwardly thereof and serve as the support for the opposite corners of a textile stock or web infeed tray 23 whose flat bottom wall slopes downwardly toward the beam 20 and toward the rear of the apparatus as best shown in FIGS. 1 and 6. The tray 23 has bracket means 24 for attaching it to the support arms 22 and the details of this bracket means are unimportant to the invention. The tray has converging side walls 25 which converge toward the rear of the apparatus and these side walls serve to funnel the textile web toward a centrally located trumpet 26 which is fixedly mounted to the top wall of the support beam 20 by a bracket 27 attached to the beam as at 28, FIG. 7. The rearwardly tapering end of the infeed tray 23 is suitably supported on the center portion of the beam 20. The forward wide end of the tray is entirely open to receive the textile stock from a doffer type roll of a carding machine, garnett or the like, not shown.

A pair of inclined and converging air nozzles 29 mounted on the arms 22 and overlying the forward corners of the tray 23 serve to gather the loosely defined textile web toward the center of the tray and to lift the stock from the tray or pan for directing it into the mouth of the trumpet 26 which further concentrates or compacts the stock.

Immediately rearwardly of the trumpet 26 are upper and lower stock feed and compression rolls 30 and 31, the lower one of which is secured to a horizontal transverse drive shaft 32 held in bearings 33 on the beam 20. The shaft 32 carries a driving sprocket gear 34 adapted to be driven by conventional power means, not shown.

The upper roll 30 is mounted on a shaft 35 carrying a gear 36 at one end thereof, in mesh with a gear 37 on the corresponding end of drive shaft 32 and driven thereby.

The upper roll 30, through its shaft 35, is urged downwardly into compressive engagement with the lower roll 31 by a pair of spaced vertical air cylinders 38 whose extensible and retractable rods 39 are coupled as at 40 to bearing collars 41 in which the shaft 35 is journaled. Cushion springs 42 on the rods 39 cushion the retraction of the rods. The air cylinders 38 are under control of a manual valve 43, FIG. 3, mounted on top of a frame structure 44 on which the cylinders 38 and associated parts are mounted. The vertical legs 45 of this frame structure are securely based on the beam 20. A safety housing 46 mounted on the beam 20 encloses the two gears 36 and 37, as shown.

Immediately rearwardly of the feed and compression rolls 30 and 31 in close fitting relation with the nip of these rolls is the tapered mouth 47 of an inclined crimping or stuffing box 48 which is essentially of one piece rigid construction, and rectangular in cross section, having a flat bottom wall 49, foreshortened top wall 50 and a pair of side walls 51, all integrally joined. The stuffing box 48 is essentially open at its forward and rear ends to allow passage of the textile stock 52 therethrough during the continuous crimping operation, which will be further described.

The crimping or stuffing box 48 includes a flat vertically swingable cover plate 53 having its forward end hinged at 54 to the slide plates 51, so that the cover plate may move downwardly between the two side walls and form with the fixed bottom wall 49 a rearwardly tapering constricted crimping passage 55. The rearward end of the plate 53 is freely disposed relative to the one piece body of the stuffing box so that a variable restricted outlet for the crimped stock is formed at the rear end of the stuffing box, FIGS. 4 and 6.

An air cylinder 56 carried by a bracket 57 rigidly attached to the stuffing box side walls has a depending plunger 58, whose rounded lower end 59 bears on the top of the cover plate 53 near the rear end of the latter and forces the same downwardly into controlled compressive contact with the textile stock being subjected to crimping in the wedge-shaped chamber 55. The plate 53 will be urged downwardly by a predetermined desirable pressure in the cylinder 56, such as 30 p.s.i., approximately. When the compressive force on the crimped stock in the chamber 55 exceeds this level, the plunger 58 will yield so that the plate 53 may rise somewhat and allow the continued passage of the textile stock through the apparatus. The arrangement maintains a relatively constant compressive force on the stock while passing through the tapering chamber 55. By comparison, the two air cylinders 38 are preferably pressurized to approximately 150 p.s.i. during the operation of the apparatus so as to exert the desired compressive force on the upper roll 30. These pressures are not extremely critical and may be varied.

The one piece stuffing box 48 has a pair of threaded spaced mounting studs 60 depending therefrom, adjustably engaged with a mounting bracket 61, FIG. 1, having a depending plate portion 62 which is preferably adjustably secured to the rear side of the beam 20. Through slots in the mounting bracket 61, not shown, the bracket itself and the stuffing box 48 may be initially properly adjusted relative to the rolls 31 and rigidly locked in place so that no further adjustment of the stuffing box will be required. The bracket 61 is stabilized by a leg support element 63 rigidly attached thereto rearwardly of the beam 20. The bracket 57 on the stuffing box is stabilized by a turnbuckle 64 or the like secured to another bracket 65 rigid with the top of cylinder support frame 44, FIG. 1. These elements of support are omitted in the other views of the drawings for the sake of clarity and simplicity of illustration and to avoid obscuring more vital elements.

Figures 3, 5:
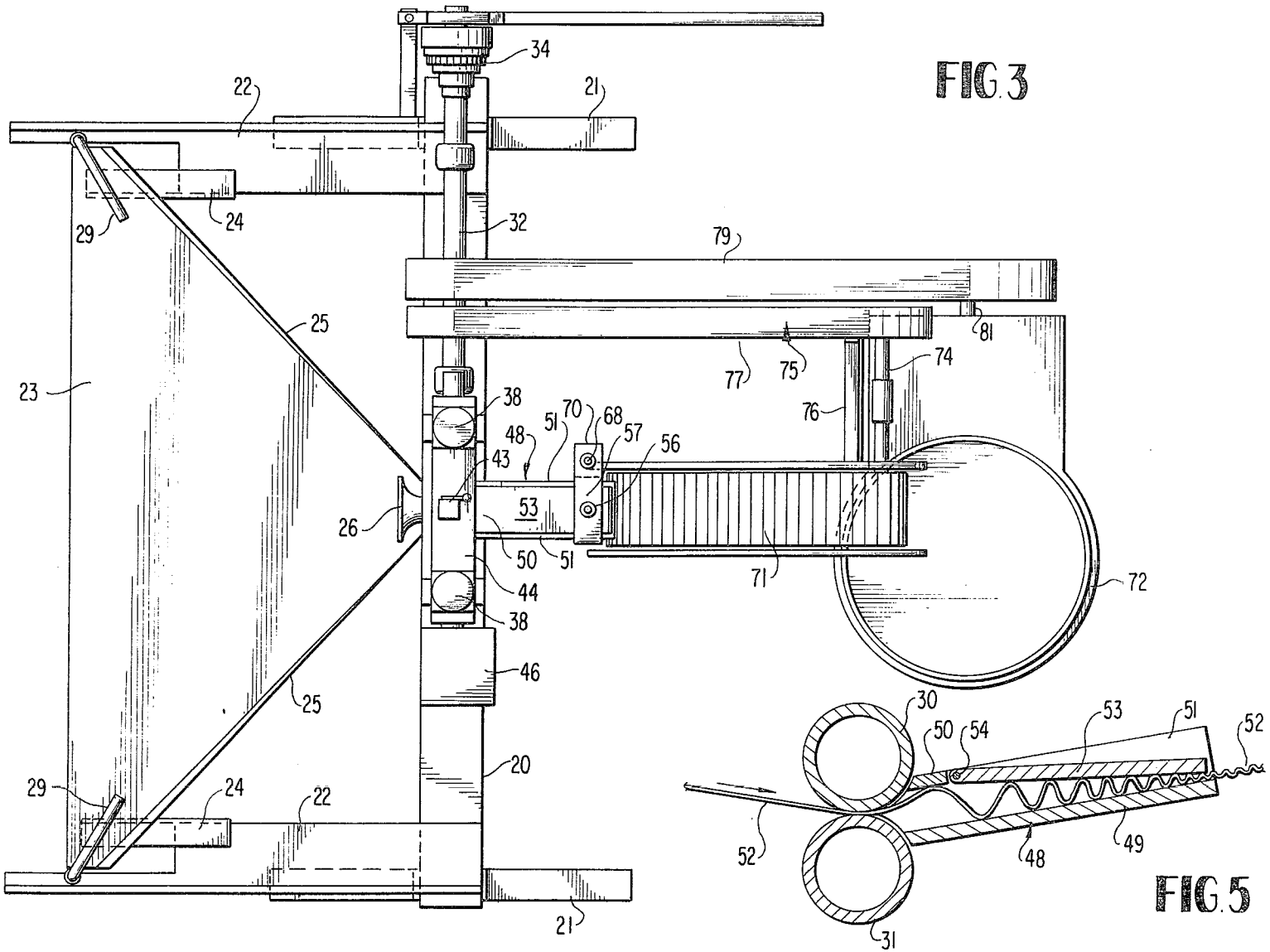
FIG. 3 is a plan view of the apparatus.
FIG. 5 is a partly diagrammatic cross sectional view taken through the stuffing box and adjacent stock feeding rolls and showing the continuous formation of crimps in the stock as it passes through the apparatus.

As shown in FIG. 4, a perforated steam pipe 66 delivers upwardly directed live steam jets 67 through the bottom wall of the stuffing box 48 near the inlet or mouth thereof and which jets impinge on the bottom of the textile stock 52 passing continuously through the stuffing box. The pipe 66 is supplied with steam from a line 68 having a valve 69 connected therein. The line or pipe 68, as shown in FIG. 3, may be stabilized and supported by a lateral extension 70 of the bracket 57.

Rearwardly of the discharge end of crimping or stuffing box 48 is an inclined slatted conveyor or elevator 71 which receives the crimped stock and carries it upwardly and rearwardly from the stuffing box for delivery into a slowly rotating stock coiling and storage can 72 mounted on a turntable 73 in offset or eccentric relation to the rear discharge end of the conveyor 71.

The upper end of the slatted conveyor 71 is powered by a horizontal transverse shaft 74, coupled with and driven by enclosed inclined gearing 75, in turn driven at its lower end by the drive shaft 32. The frame of conveyor 71 may be supported by a side bracket arm 76 secured to the housing 77 for gearing 75.

Similarly, gearing 78, such as a chain drive coupled with the drive shaft 32 and driven thereby, extends rearwardly through a floor based housing 79 and is operatively engaged with a sprocket gear 80, FIG. 8, on a horizontal shaft 81 held in bearings 82. The shaft 81, through additional gearing 83 and 84, drives a turntable gear 85 which produces rotation of the aforementioned turntable 73 on which the rotating can 72 is positioned for receiving and coiling the crimped stock gently and without tensioning it.

OPERATION

While the operation of the apparatus should be generally clear from the foregoing detailed description, nevertheless it may be summarized as follows.

A loosely defined textile web is taken from a carding machine or garnett and led onto the pan 23, where the action of the air nozzles 29 concentrates the web at the center of the pan and boosts it into the trumpet 26, from which the feed and compression rolls 30 and 31 deliver the compacted and now well defined web into the mouth of stuffing box 48, as shown in FIGS. 5 and 6. In the stuffing box, the continued feeding of the web or stock by the rolls 30 and 31 coupled with the retarding action of the pressurized top plate 53 and the dampening action of the steam jets 67 cause the web to be continually uniformly crimped in a zigzig pattern, as illustrated. The crimping of the material will be permanent due to mechanical stressing of the fibers in the continuous crimping process. The material is useful as batting or padding for sleeping bags, mattresses, quilts, jackets and other well known applications.

Following its discharge from the stuffing box in a uniformly and permanently crimped state, the product is neatly delivered into the rotating can 72 in a coiled state and without stretching the material, as described.

The apparatus is efficient and simplified and accomplishes the complete handling or processing of the textile material from the time it is discharged from a card or the like onto the pan 23 until its delivery as a crimped product into the can 72. The advantages of the invention over the prior art should be apparent to those skilled in the art.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A textile crimping apparatus comprising a tray adapted to receive a textile web in loosely defined form, a trumpet arranged near one end of said tray and somewhat thereabove to receive said web, converging fluid jet nozzle means associated with the tray and assisting in delivering said web to the mouth of the trumpet in a more concentrated form, a pair of superposed web feed and compression rolls receiving the web immediately behind the trumpet, a stufffing box receiving the web from said rolls and mounted directly therebehind, the stuffing box having a hinged top plate which is vertically shiftable, power means for exerting a controlled downward pressure on said top plate, an elevating power conveyor for a crimped web receiving the web immediately rearwardly of said stuffing box, and a rotatable web coiling and storage receptacle beneath the rear discharge end of the power conveyor and offset laterally therefrom, and common power means driving said rolls, conveyor and receptacle.

2. A textile crimping apparatus according to claim 1, and said tray sloping downwardly and rearwardly from its leading transverse edge and having rearwardly converging side walls, the rearward relatively narrow end of the tray being substantially directly below the mouth of said trumpet, and said trumpet having a substantially horizontal axis.

3. A textile crimping apparatus according to claim 2, and said jet nozzle means comprising a single pair of rearwardly converging air jet nozzles mounted near the forward corners of said tray.

4. A textile crimping apparatus according to claim 3, and a main support frame for the apparatus including a transverse horizontal beam and forwardly extending outrigger arms, said outrigger arms extending beneath and supporting the forward corners of the tray, and the rear relatively narrow end of the tray resting on said beam, and said beam supporting said trumpet.

5. A textile crimping apparatus as defined in claim 4, and an upstanding frame structure on said beam and extending above said web feed and compression rolls, vertically extensible and retractable power means on said upstanding frame and coupled with the upper roll of said superposed pair and applying controlled pressure on the upper roll during rotation of said rolls.

6. A textile crimping apparatus as defined in claim 5, and said vertically extensible and retractable power means comprising a pair of upstanding air cylinders having piston rods associated therewith, a rotatable support shaft for said upper roll, said piston rods coupled with the upper roll support shaft, and gears drivingly interconnecting the lower and upper rolls, the lower roll only being positively driven by the common power means.

7. A textile crimping apparatus as defined in claim 1, wherein said stuffing box includes a one piece rectangular cross sectional body open at its opposite ends and having side walls adapted to receive said hinged top plate therebetween.

8. A textile crimping apparatus as defined in claim 7, and said power means for exerting downward pressure on said top plate including a fluid pressure operated cylinder and a plunger element powered by the cylinder and directly contacting the top plate at a point spaced from the hinge of the top plate.

9. A textile crimping apparatus as defined in claim 8, and support bracket means for said fluid pressure operated cylinder attached to the body of the stuffing box.

10. A textile crimping apparatus as defined in claim 7, and a support bracket for said stuffing box on which the stuffing box is adjustably mounted, said bracket attached to a main support member of the apparatus for adjustment in another direction.

11. A textile crimping apparatus as defined in claim 7, and means for injecting steam upwardly through the bottom wall of said stuffing box near the forward end thereof.

12. A textile crimping apparatus as defined in claim 11, and said steam injecting means including a perforated pipe spanning the stuffing box bottom wall transversely.

* * * * *